United States Patent [19]

Carter

[11] Patent Number: 5,010,615

[45] Date of Patent: Apr. 30, 1991

[54] HAND-HOLDABLE TOOL HAVING A DETACHABLE HANDLE

[76] Inventor: Patricia Carter, 726 Kimberly Ct., Radcliff, Ky. 40160

[21] Appl. No.: 386,434

[22] Filed: Jul. 28, 1989

[51] Int. Cl.[5] ..... A47L 13/17; A47L 17/08; B25G 3/18

[52] U.S. Cl. ..... 15/104.94; 15/145; 15/209 D

[58] Field of Search ..... 15/145, 146, 147 R, 15/147 A, 171, 176.1, 176.6, 177, 178, 209 D, 211, 104.93, 104.94, 167.1; 16/114

[56] References Cited

U.S. PATENT DOCUMENTS

| | | | |
|---|---|---|---|
| 72,608 | 5/1868 | Hale | 15/145 |
| 380,698 | 4/1888 | Schott | 15/145 |
| 844,130 | 2/1907 | Howard | 15/145 |
| 1,616,315 | 2/1927 | French | 15/146 |
| 1,638,800 | 8/1927 | D'Albora | 15/209 D |
| 1,859,425 | 5/1932 | Bell | 15/176.6 |
| 2,494,159 | 1/1950 | Bernstein | 16/114 A |
| 2,501,940 | 3/1950 | Hibbard | 16/114 A |
| 2,679,064 | 5/1954 | Palma, Jr. et al. | 15/145 |
| 2,810,150 | 10/1957 | Ellman | 15/145 |
| 3,059,262 | 10/1962 | Marschner | 15/145 |
| 3,072,938 | 1/1963 | Phaneuf | 15/176.6 |
| 3,226,753 | 1/1966 | Charlap | 15/104.93 |
| 3,533,122 | 10/1970 | Hesener | 15/147 A |
| 4,127,911 | 12/1978 | Cupp et al. | 15/145 |
| 4,592,109 | 6/1986 | Borea et al. | 15/145 |
| 4,598,437 | 7/1986 | Ernest et al. | 15/145 |
| 4,729,587 | 3/1988 | Ward | 15/146 |
| 4,852,201 | 8/1989 | Wundrock et al. | 15/145 |

*Primary Examiner*—Harvey C. Hornsby
*Assistant Examiner*—Scott J. Haugland
*Attorney, Agent, or Firm*—Terry M. Gernstein

[57] ABSTRACT

A hand-holdable tool includes a handle that is detachably connected to a head unit by a locking and release mechanism that includes a snap lock on the handle and a snap lock receiver located interiorly of the head unit. A soap impregnated cleaning pad of special steel can be attached to the head unit.

13 Claims, 4 Drawing Sheets

HAND-HOLDABLE TOOL HAVING A DETACHABLE HANDLE

TECHNICAL FIELD OF THE INVENTION

The present invention relates to the general art of hand-holdable tools, and to the particular field of cleaning and scrubbing tools.

BACKGROUND OF THE INVENTION

Man cleaning operations require use of a scrubbing-type device. Such operations range from household chores such as dishwashing, appliance cleaning and structural cleaning and scrubbing, and the like, to industrial cleaning jobs such as cleaning the outside of a building, cleaning large equipment, and the like, which may require abrasive and caustic chemicals. The operations can range from cleaning and scrubbing to complex operations involving cleaning, scrubbing and soaping steps.

Many various implements have been proposed to expedite such operations, These implements have included scouring brushes, scrub brushes, dust mops, and the like, and many such devices have included handles so the user need not directly contact the cleaning material or the article being cleaned. Use of a handle has several advantages, especially if the cleaning procedure or material may expose the user to harsh, abrasive or dangerous chemicals or materials.

While effective, many of these handled implements have had problems that have inhibited their full commercial acceptance. For example, once the device is used, it may become soiled and thus onerous to store and/or use again, especially in the case where dangerous or harsh chemicals are used. After a certain number of uses, the cleaning element of the device may have to be discarded. Discarding an entire cleaning implement can be expensive, thereby placing such implements at a commercial disadvantage with respect to other items on the market.

Another problem with many of these known devices is the difficulty associated with the manipulation thereof, and many users often wear some sort of protective gloves, thus exacerbating any manipulative difficulties of the device.

While devices such as disclosed in U.S. Pat. Nos. 2,810,150, 3,306,647, 4,466,152, and the like, alleviate the aforementioned economic drawbacks associated with discarding the entire device by using a detachable handle with a cleaning device, such devices still do not alleviate the above-mentioned manipulative problems. In fact, such devices may tend to worsen such manipulative problems because they often use a difficult-to-use release mechanism.

Still further, many of these devices have the handle release mechanism and the device elements associated with such release mechanism located where it is subject to contact with the cleaning material and/or with the surface being cleaned. Such contact may damage or clog the mechanism thereby making it even more difficult to operate, if not totally disabling it. Such contact may also tend to jam the device thereby inhibiting the handle-releasing action of the device, even if the release mechanism is not totally disabled.

Still further, some of the detachable handle devices have complicated release mechanisms thereby increasing the cost thereof and vitiating any advantages achieved by the re-usable nature of the handle.

Many of the detachable handle devices also have a release mechanism that tends to degrade after many uses thereby necessitating the purchase of an entirely new device. This, again, vitiates the economic advantages obtained by the re-usable design. The release mechanism may not be totally secure to begin with, and if degraded, creates further problems such as accidental separation of the handle from the head.

Most cleaning and/or scrubbing elements can become worn after use so a device on which such elements are mounted should be amenable to use in several different orientations if full use of the cleaning element is to be made. Multi-orientation use will permit the device to be re-oriented to use a new part of the cleaning element as one part becomes worn. However, the handle of most known handle-detachable devices can only be attached to the head in one orientation with respect to the head unit on which the cleaning element is mounted. This requires the handle to be universally grippable. That is, the device must be amenable to being grasped and used in any manner. This is generally achieved using a symmetrically consistent handle, such as a cylindrical rod or the like.

While this requirement may seem innocuous, it presents a drawback, especially if the cleaning implement should by shaped to provide comfort as well as efficient force application and secure gripping. While a cylindrical rod may be satisfactory for some purposes, it may not be amenable to an extremely secure grip without added elements, such as finger grips or the like. However, such finger-grip elements cannot be added to known devices for the just-stated reasons since they will be out of position, and can, in fact, be a hinderance, in some situations.

Therefore, there is a need for a hand-holdable tool having a reusable handle that is detachably connected to a head unit in a manner that is reliable, universal, easily manipulated and long-lived, yet is still economical to manufacture and use.

OBJECTS OF THE INVENTION

It is a main object of the present invention to provide a hand-holdable tool having a reusable handle that is detachably connected to a head unit in a manner that is reliable, universal, easily manipulated and long-lived.

It is another object of the present invention to provide a hand-holdable tool having a reusable handle that is detachably connected to a head unit in a manner that is reliable, universal, easily manipulated and long-lived yet is economical to manufacture and to use.

SUMMARY OF THE INVENTION

These, and other, objects are achieved by a hand-holdable device which has a handle unit detachably connected to a head unit by a simple mechanism that is located interiorly of the head unit and which can connect the head to the handle in a variety of orientations, yet is easily manipulated.

The release mechanism is operated by simply applying pressure to a flexible arm. Thus, a user wearing gloves, or having some disability which inhibits the nimbleness of their hands or fingers, can still easily operate the release mechanism. However, by being located inside the head unit, the elements connecting the handle to the head unit are protected against contact with abrasive, cleaners, or other such elements that may tend to damage or jam the release and locking mechanism.

The locking and release mechanism elements of the device embodying the present invention are quite simple thereby keeping manufacturing costs down while still further improving the reliability of the device and the ease with which it is used as well as improving the long-lived nature thereof.

The locking and release mechanism of the device embodying the present invention is designed to operate in at least two handle/head unit relative orientations so the handle can be rotated with respect to the head unit. Because of this feature, the handle can include special hand gripping elements to improve a user's grip and leverage when using the device, yet the head unit can still be oriented to have the most effective surface of a cleaning element which is mounted thereon, contact the surface being cleaned. Thus, for example, should one portion of the cleaning element degrade due to use, the head unit can be rotated so another portion of the cleaning element can be used while still permitting the user to use finger-gripping elements to improve their grip and/or leverage. In this manner, several different cleaning surface characteristics can be included on one single cleaning element, and that element rotated as necessary. The unit can thus expose the most effective cleaning surface for any particular job, while still permitting a user to have an effective and efficient grip that is not inhibited either by an absence of an extra gripping surface or by having such extra gripping surface in an awkward orientation or position with respect to the user's hand.

DETAILED DESCRIPTION OF THE PREFERRED EMBODIMENT OF THE INVENTION

Figure 1:
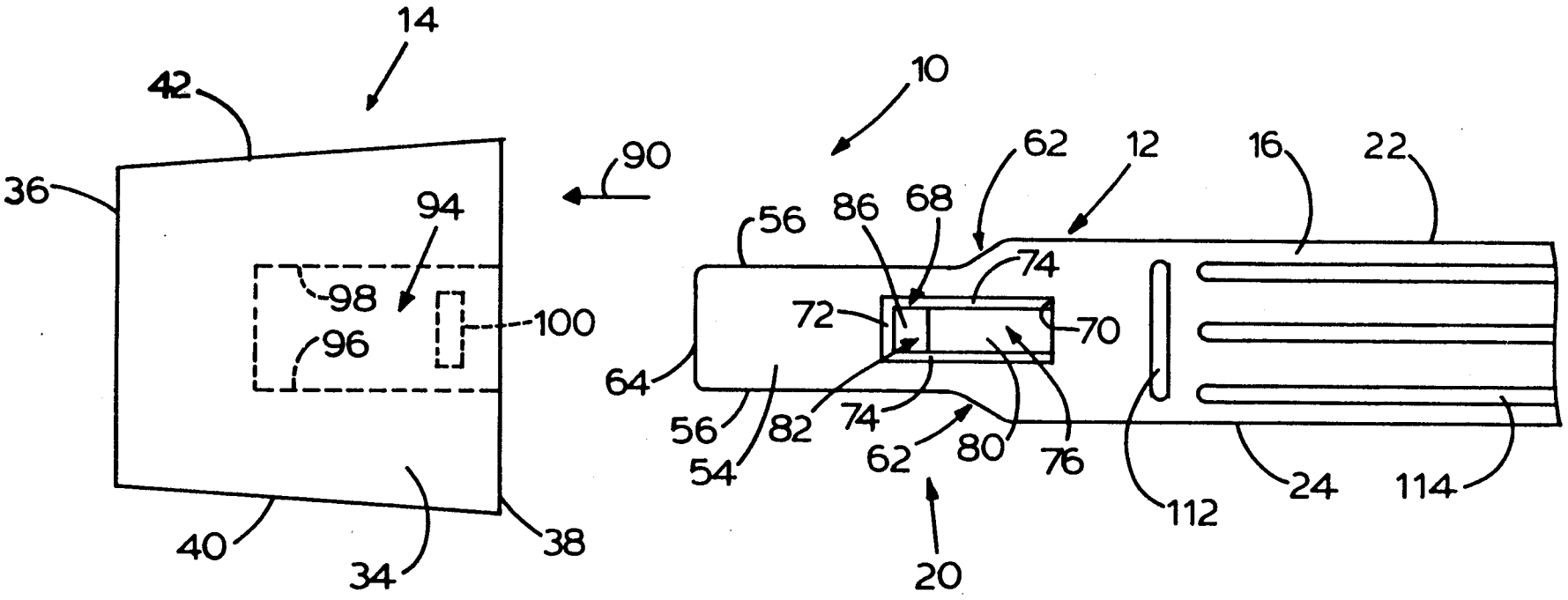
FIG. 1 is a top plan view of the hand-holdable device embodying the present invention.
Figure 2:
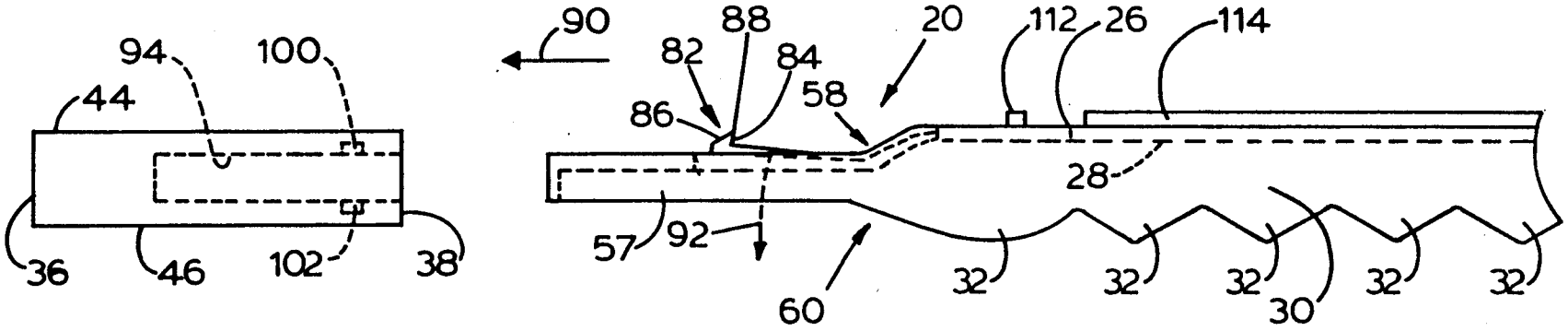
FIG. 2 is a side elevational view of the hand-holdable device embodying the present invention.

Shown in FIGS. 1 and 2 is a hand-holdable device 10 embodying the present invention. The device 10 includes a handle unit 12 and a head unit 14 which are releasably coupled together by a locking and release mechanism that will be more fully discussed below.

The handle unit 12 includes a body 16 having a rear end, a front end 20, sides 22 and 24, a top surface 26 and a bottom surface 28. As is best shown in FIG. 2, the sides and the rear have depending portions, such as portion 30, and the bottom surface of the handle unit is located inside the side portions. Finger-grip elements 32 are located on the lower edges of the side depending portions. This permits a user to grasp the handle unit comfortably yet securely with their fingers will curl into the cavity defined by the depending side portions. As can be seen in FIG. 2, the finger-grip elements 32 decrease in size rearwardly of the handle unit. This permits a user to firmly grasp the forward portion of the handle with their thumb and forefinger and to rest their little finger on the rear of the handle. The thumb and forefinger are thus located in position to apply the most force with the most effective leverage while still remaining comfortable to grip.

The head unit 14 includes a body element 34 having a forward end 36, an aft end 38, sides 40 and 42 an upper surface 44 and a lower surface 46. A cleaning and scrubbing element is mounted on the head unit, and the head unit can be any suitable shape and size with the shape and size shown in the figures being only representative of the various sizes and shapes. The handle can also be a variety of sizes and shapes and the figures only show a representation of such sizes and shapes.

The handle unit 12 is detachably coupled to the head unit 14 by a release and locking mechanism. This release and locking mechanism includes a snap locking assembly 50 on the handle unit and an interiorly located snap lock assembly receiving means 52 on the head element.

The snap locking assembly 50 includes a neck portion 54 on the front end of the handle unit, with the neck portion being reduced in width as measured between sides 56 thereof and is thickness as measured between the lowermost portions of edges 57 thereof and the top surface thereof that are both reduced from the corresponding dimensions of the rest of the handle unit body so that a top shoulder 58, a bottom shoulder 60 and side shoulders 62 are defined where the neck portion joins the remainder of the body. The neck portion has a forwardmost end 64 that is remotely located from the shoulder portions.

A cutout 68 is defined in the body and extends through the shoulder section into the neck portion. The cutout includes a rear end 70, a front end 72 and sides 74.

A flexible arm 76 is connected at a rear end thereof to the body at the cutout rear end 70 and extends in cantilever fashion towards the cutout front end 72. The flexible arm includes a top surface 80 and is biased into a position to have that top surface located to be essentially flush with the top surface of the body. A tooth 82 is mounted on the flexible arm at a location that is spaced from the cutout rear, and includes a shoulder 84 which extends essentially vertically upward from the top surface of the flexible arm and a sloping ramp 86 which intersects the shoulder 84 to form an apex 88 spaced above the arm top surface, and then slopes downwardly from that apex away from the cutout rear end 70.

As can be seen in FIG. 2, the tooth 82 is located above the plane of the neck top surface with the sloping ramp presented toward the forward end 64 to lead the tooth when the handle is moved towards the head unit in direction 90. The arm can be forced downwardly, as indicated in FIG. 2 by arrow 92 against the bias of the arm for a purpose that will be evident from the ensuing discussion, and will return to the FIG. 2 position under the influence of such bias.

The head unit 14 includes a snap locking assembly receiving means on the aft end 38. The receiving means includes a channel 94 defined in that head unit to extend from the aft end 38 toward the head unit forward end 36 for a distance that corresponds to the length of the handle unit neck portion as measured from the forwardmost end 64 to the shoulders, and has a width as measured between sides 96 and 98 that corresponds to the width of the neck portion as measured between the sides 56 thereof so that the neck portion can be slipped into the channel until the shoulders of the body contact the head unit aft end 38.

Two recesses 100 and 102 are defined in the head unit body to open into the channel 94 and are located to receive the tooth 82 when the neck portion is fully inserted into the channel 94. Each recess includes a ledge 103 located toward the forward end 38. As can be seen in FIG. 2, since the tooth is located above the surface of the neck portion, this tooth will move into a recess as soon as the tooth and the recess are aligned. The ramp 86 contacts the head unit body and forces the flexible arm downwardly in the direction 92 so the tooth will clear the body located adjacent to the channel. However, as soon as the tooth aligns with a recess, the bias of the flexible arm causes that arm to move in the direction opposite to that shown by arrow 92 to force the tooth into the recess. Retrograde movement of the handle with respect to the direction shown by arrow 90 will not be permitted by contact between the tooth shoulder 84 and the ledge 103 formed by the head unit body adjacent to the recess containing the tooth.

Since there are two recesses, 100 and 102, the handle can be connected to the head unit in the orientation shown in FIG. 2 or in an orientation that is inverted to that shown in FIG. 2.

The handle is disconnected from the head unit by simply pushing on the flexible arm adjacent to the cutout rear end 70 in the direction indicated by arrow 92 to free the tooth shoulder 84 from engagement with the head unit body, and pulling the handle in the direction opposite to that indicated by arrow 90. As soon as the tooth clears the head unit aft end 38, the resiliency of the arm will cause that arm to move back into the position shown in FIG. 2.

Further gripping means are included on the handle unit to further improve the user's grip, and such further means includes a transverse rib 112 and a plurality of longitudinally extending ribs, such as rib 114, which extend along the longitudinal axis of the handle unit.

Figure 3:
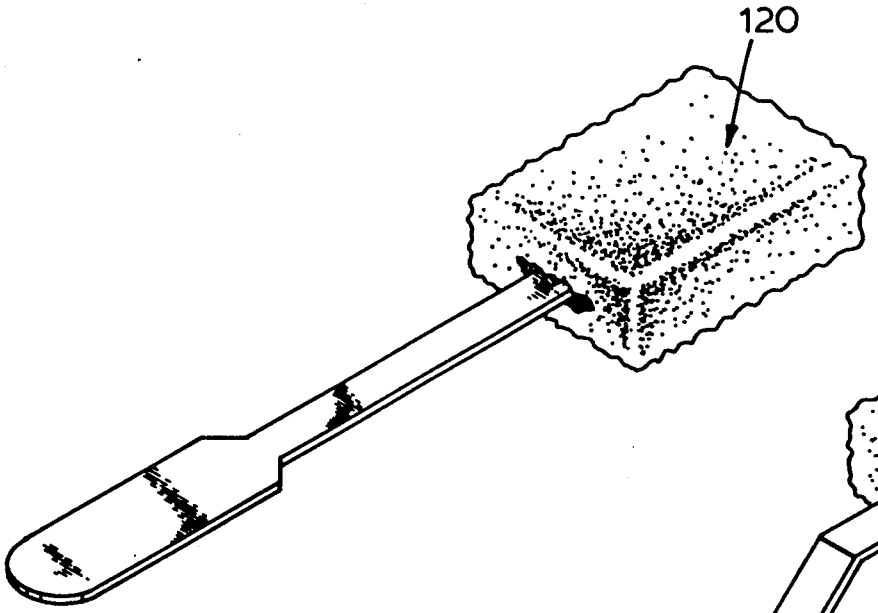
FIG. 3 is a perspective vieW of a hand-holdable device embodying the present invention in conjunction with a cleaning element mounted on a head unit of the device.
Figure 4:
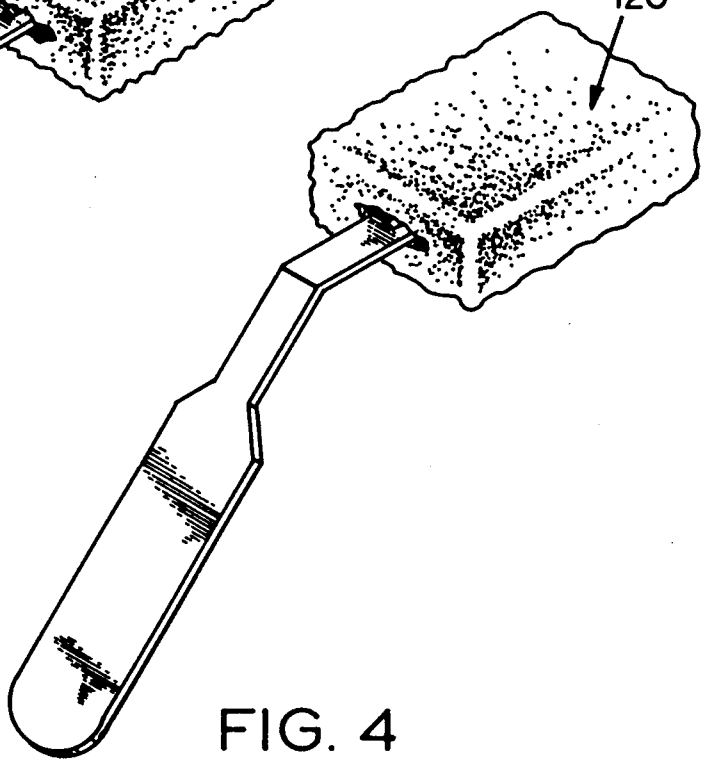
FIG. 4 is a perspective view of another hand-holdable device embodying the present invention in conjunction with a cleaning element mounted on a head unit of the device.
Figure 5:
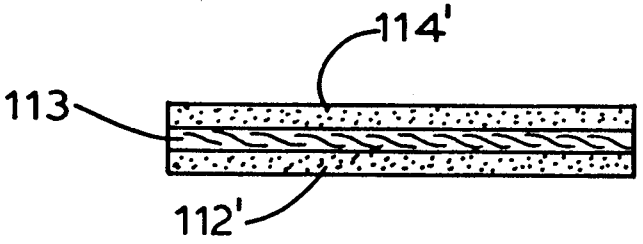
FIG. 5 (PRIOR ART)
FIG. 5 is an end elevational view of a scrub pad used in the hand-holdable tool.
Figure 6:
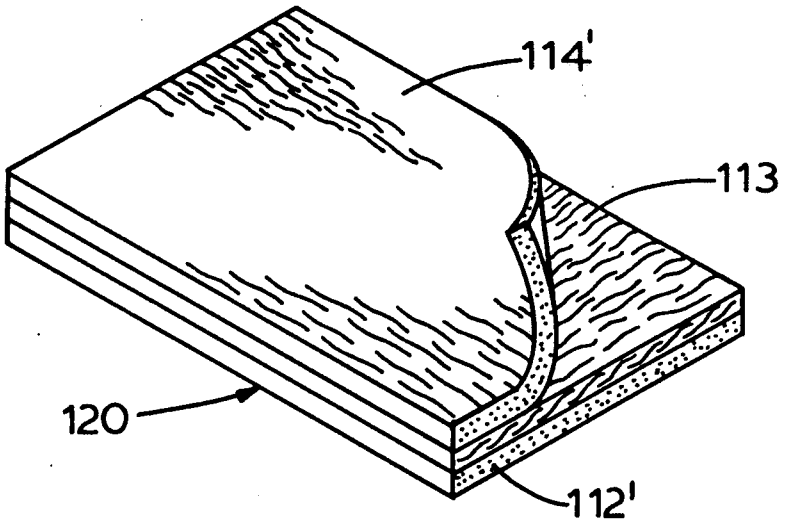
FIG. 6 (PRIOR ART)
FIG. 6 is a perspective view of the pad having one layer unfelted and rolled back.

As indicated in FIGS. 3 and 4, the handle can assume various shapes and configurations, such as the straight configuration shown in FIG. 3 or the angled configuration shown in FIG. 4. It is noted that the handles in FIGS. 3 and 4 are not shown as including the finger-grip means or the ribs; however, this is for the sake of convenience, and such elements will be included in the FIGS. 3 and 4 embodiments as well.

As is also shown in FIGS. 3 and 4, a cleaning element 120 is mounted on the head unit. This cleaning element is preferably a steel wool like element that can have soap impregnated therein as is fully discussed in copending application titled "Soap Impregnated Scrub Pad of Felted Metal Wool", filed concurrently herewith by the same inventor. The disclosure of such copending application is incorporated herein by reference, and thus will not be fully described herein. As discussed in that incorporated application, a steel pad such as disclosed in U.S. Pat. No. 3,148,105 (the disclosure of which is incorporated herein by reference) is impregnated with soap. This pad is then mounted on the head unit, and can be used for a wide variety of purposes. Other pads which can be used in conjunction with the tool disclosed herein are disclosed in U.S. Pat. Nos. 2,896,242 and 3,034,169, the disclosures of which are incorporated herein by reference.

The scrub pad 120 is shown in FIGS. 3, 4, 5 and 6. As disclosed in the reference patent application, the scrub pad is prepared by providing a pad of felted metal wool as disclosed in the reference U.S. Pat. No. 3,148,105 which has a length and a breadth and consists of a plurality of layers of metallic strands secured together. Substantially all of the strands of each layer extend substantially continuously in one direction, with most of the strands of at least one layer extending parallel to the breadth of the pad, and the most of the strands of at least another layer extending parallel to the length of the pad. The layers are secured together with one portion of a substantial number of strands of one layer drawn and deflected from the interior of the layer through the entire thickness of an adjacent layer and to the opposite surface of the adjacent layer. Thus, the pad 120 includes layers 112', 113 and 114' which are felted together. The strands in layer 113 extend crosswise of the pad 120 and the strands in layer 114' extend lengthwise of the pad. A felting machine has needles which pick up strands in layer 114' and carry those strands through the layers 112' and 113 and also pick up strands from the layer 113 and carry those strands through layer 112'. The machine needles also force strands in the opposite direction as discussed in the reference patent.

As disclosed in the reference patent application, the scrub pad is impregnated with a soap mixture consisting of 180 ml of anionic surfactant, 60 ml of surfactant, 1 teaspoon of metal polish, 60 ml of 70% ethyl alcohol, and 30 ml of water. This mixture is applied to the pad either by dipping the pad into the mixture or spraying that mixture onto the pad. The pad is then dried at 250 F. for one hour. This soap mixture remains in place on the pad.

It is understood that while certain forms of the present invention have been illustrated and described herein, it is not to be limited to the specific forms or arrangements of parts described and shown.

I claim:

1. A hand-holdable tool comprising:

(A) a handle unit which includes a body having a rear end, a front end, sides, a top surface, and a bottom surface;

(B) a head unit which includes a body element having a forward end, an aft end, sides and an upper surface and a lower surface; and (C) a locking and release mechanism detachably connecting said handle unit to said head unit and which includes (1) a neck portion on the front end of said handle unit body, (2) a cutout defined in said handle unit body and extending into said body neck portion and being defined by said body to have a rear end, a front end and sides, said cutout front end being located in said neck portion and said cutout rear end being located in said body, said neck portion having a top surface which is spaced from said body top surface, said neck portion having a curved shoulder portion connecting said neck portion top surface to said body top surface;

(3) a flexible arm connected at a rear end thereof to said body at said cutout rear end and extending into said cutout and into said neck portion and having a forward end thereof located adjacent to said cutout front end, said flexible arm having a top surface which is located adjacent to said body top surface, said flexible arm top surface being flush with said body top surface and with said neck portion top surface and with said curved shoulder for essentially the entire length of said flexible arm from the flexible arm rear end to the flexible arm forward end, (4) a tooth on said flexible arm and located adjacent to said flexible arm forward end, said tooth including (a) a shoulder which extends upwardly from said flexible arm top surface, and (b) a ramp which intersects said tooth shoulder at a location spaced above said flexible arm top surface to form an apex, and which slopes downwardly from said apex toward said flexible arm forward end, (5) said flexible arm being spaced from said cutout front end and sides and being movable with respect to said body toward said neck body bottom surface and being connected to said body to be biased into a position to locate said tooth apex above said neck portion top surface, said arm being movable against said bias to locate said tooth apex beneath said neck portion top surface, (6) a neck portion receiving channel defined interiorly of said head unit body element to extend from said body element aft end towards said body element forward end and being sized to accommodate said body neck portion, and (7) lock receiving means defined in said head unit body element and located adjacent to said channel and including a recess defined in said body element and opening into said channel, said body element having a ledge defining one side of said recess with said ledge being located to abut said tooth shoulder when said neck portion is fully inserted into said channel with said apex positioned above said neck portion top surface to lock said head unit to said handle unit.

2. The hand-holdable tool defined in claim 1 further including a second recess defined in said head unit body element to open into said channel.

3. The hand-holdable tool defined in claim 2 wherein said handle unit body includes a width as measured between said sides and a shoulder portion having a shoulder sides and a width as measured between said shoulder portion sides that is less than the width of said handle unit body.

4. The hand-holdable tool defined in claim 3 wherein said handle unit further includes a transverse rib on said handle unit upper surface extending from one handle unit body side towards the other handle body unit side adjacent to said neck portion shoulder and a plurality of longitudinal ribs on said handle body unit upper surface extending from adjacent to said handle body unit aft end to adjacent to said handle body unit transverse rib.

5. The hand-holdable tool defined in claim 2 wherein said handle unit body further includes sides and finger-grip means located on said sides.

6. The hand-holdable tool defined in claim 5 wherein said finger-grip means are located beneath said handle unit body bottom surface.

7. The hand-holdable tool defined in claim 6 wherein said flexible arm extends along a central axis of said handle unit body.

8. The hand-holdable tool defined in claim 2 wherein said recess is defined in said head unit body element to be adjacent to said head unit body element upper surface.

9. The hand-holdable tool defined in claim 8 wherein said second recess is defined in said head unit body element to be adjacent to said head unit body element lower surface.

10. The hand-holdable device defined in claim 9 further including palm gripping means on said handle unit body.

11. A hand-holdable tool comprising:

(A) a handle unit which includes a body having a rear end, a front end, sides, a top surface, and a bottom surface;

(B) a head unit which includes a body element having a forward end, an aft end, sides and an upper surface and a lower surface; and (C) a locking and release mechanism detachably connecting said handle unit to said head unit and which includes (1) a neck portion on the front end of said handle unit body, (2) a cutout defined in said handle unit body and extending into said body neck portion and being defined by said body to have a rear end, a front end and sides, said cutout front end being located in said neck portion and said cutout rear end being located in said body, said neck portion having a top surface which is spaced from said body top surface, said neck portion having a curved shoulder portion connecting said neck portion top surface to said body top surface, (3) a flexible arm connected at a rear end thereof to said body at said cutout rear end and extending into said cutout and into said neck portion and having a forward end thereof located adjacent to said cutout front end, said flexible arm having a top surface which is located adjacent to said body top surface, said flexible arm top surface being flush with said body top surface, and with said shoulder portion and with said neck portion top surface for essentially the entire length of said flexible arm from the flexible arm rear end to the flexible arm forward end, (4) a tooth on said flexible arm and located adjacent to said flexible arm forward end, said tooth including (a) a shoulder which extends upwardly from said flexible arm top surface, and (b) a ramp which intersects said tooth shoulder at a location spaced above said flexible arm top surface to form an apex, and which slopes downwardly from said apex toward said flexible arm forward end, (5) said flexible arm being spaced from said cutout front end and sides and being movable with respect to said body toward said neck body bottom surface and being connected to said body to be biased into a position to locate said tooth apex above said neck portion top surface, said arm being movable against said bias to locate said tooth apex beneath said neck portion top surface, (6) a neck portion receiving channel defined interiorly of said head unit body element to extend from said body element aft end towards said body element forward end and being sized to accommodate said body neck portion, and (7) lock receiving means defined in said head unit body element and located adjacent to said channel and including a recess defined in said body element and opening into said channel, said body element having a ledge defining one side of said recess with said ledge being located to abut said tooth shoulder when said neck portion is fully inserted into said channel with said apex positioned above said neck portion top surface to lock said head unit to said handle unit; and (7) a cleaning element mounted on said head unit body element, said cleaning element including a pad having a length and a breadth and including a plurality of layers of metallic strands secured together, substantially all of the strands of each layer extending substantially continuously in one direction, most of the strands of at least one layer extending parallel to the breadth of the pad, and the most of the strands of at least another layer extending parallel to the length of the pad; in combination with means for securing the layers together which includes a portion of a substantial number of strands of one layer, drawn and deflected from the interior of said layer through the entire thickness of an adjacent layer and to the opposite surface of such adjacent layer; and (E) soap impregnated in said pad.

12. A hand-holdable tool comprising:

(A) a handle unit which includes a body having a rear end, a front end, sides, a top surface, and a bottom surface;

(B) a head unit which includes a body element having forward end, an aft end, sides and an upper surface and a lower surface; and (C) a locking and release mechanism deteachably connecting said handle unit to said head unit and which includes (1) a neck portion on the front end of said handle unit body, (2) a cutout defined in said handle unit body and extending into said body neck portion and being defined by said body to have a rear end, a front end and sides, said cutout front end being located in said neck portion and said cutout rear end being located in said body, said neck portion having a top surface which is spaced from said body top surface, said neck portion having a curved shoulder portion connecting said neck portion top surface to said body top surface, (3) a flexible arm connected at a rear end thereof to said body at said cutout rear end and extending into said cutout and into said neck portion and having a forward end thereof located adjacent to said cutout front end, said flexible arm having a top surface which is located adjacent to said body top surface, said flexible arm top surface being flush with said body top surface and with said neck portion top surface and with said shoulder for essentially the entire length of said flexible arm from the flexible arm rear end to the flexible arm forward end, (4) a tooth on said flexible arm and located adjacent to said flexible arm forward end, said tooth including (a) a shoulder which extends upwardly from said flexible arm top surface, and (b) a ramp which intersects said tooth shoulder at a location spaced above said flexible arm top surface to form an apex, and which slopes downwardly from said apex toward said flexible arm forward end, (5) said flexible arm being spaced from said cutout front end and sides and being movable with respect to said body toward said neck body bottom surface and being connected to said body to be biased into a position to locate said tooth apex above said neck portion top surface, said arm being movable against said bias to locate said tooth apex beneath said neck portion top surface, (6) a neck portion receiving channel defined interiorly of said head unit body element to extend from said body element aft end towards said body element forward end and being sized to accommodate said body neck portion, and (7) lock receiving means defined in said head unit body element and located adjacent to said channel and including a recessed defined in said body element and opening into said channel, said body element having a ledge defining one side of said recess with said ledge being located to abut said tooth shoulder when said neck portion is fully inserted into said channel with said apex positioned above said neck portion top surface to lock said head unit to said handle unit; and (D) a cleaning element mounted on said head unit body element 13. The hand-holdable tool defined in claim 12 wherein said soap impregnated in said pad includes 180 ml of anionic surfactant,
60 ml of surfactant;
1 teaspoon of metal polish,
60 ml of 70% ethyl alcohol, and
30 ml of water.

* * * * *